United States Patent [19]

Largeteau

[11] 4,301,624

[45] Nov. 24, 1981

[54] GRINDING HEADS

[75] Inventor: Pierre A. Largeteau, Bezons, France

[73] Assignees: S.A. Automobiles Citroen; Societe Automobiles Peugeot, both of Paris, France

[21] Appl. No.: 41,186

[22] Filed: May 21, 1979

[30] Foreign Application Priority Data

May 30, 1978 [FR] France ..... 78 16680

[51] Int. Cl.[3] ..... B24B 5/08

[52] U.S. Cl. ..... 51/34 J; 51/165.9; 51/338

[58] Field of Search ..... 51/34 J, 165.9, 338, 51/339, 346, 349, 350, 355, 363, 372, 373, 375

[56] References Cited

U.S. PATENT DOCUMENTS

| | | | |
|---|---|---|---|
| 2,195,055 | 3/1940 | Wallace | 51/338 |
| 2,631,414 | 3/1953 | Muehling | 51/349 X |
| 2,844,920 | 7/1958 | Calvert | 51/338 X |
| 3,619,956 | 11/1971 | Gehring | 51/349 |
| 3,742,653 | 7/1973 | Kano et al. | 51/165.9 |

*Primary Examiner*—Gary L. Smith
*Assistant Examiner*—Robert P. Olszewski
*Attorney, Agent, or Firm*—Karl F. Ross

[57] ABSTRACT

A grinding head of the type comprising an expansible grinder adjusted by an expansion cone connected to an expansion rod, comprises a differential action hydraulic ram for operating the expansion rod. The piston of the ram is connected to the expansion rod, and the piston is slaved in position by means of a hydraulic slide valve. The valve slider is operated by a stepping motor which is program-controlled.

5 Claims, 3 Drawing Figures

GRINDING HEADS

FIELD OF THE INVENTION

The present invention relates to grinding heads, and more particularly to a device for controlling expansion of a grinder of a grinding head.

BACKGROUND OF THE INVENTION

Grinding heads fitted with expansible grinders conventionally comprise means for rotating the grinder and moving same axially, as well as a device for controlling the expansion of the grinder.

Expansible grinders usually comprise abrasive stones, or diamonds, disposed along the generatrices of a cylinder and able to move radially under the action of a cone fixed to an expansion rod. The expansion rod may be moved, for example, by the piston of a hydraulic ram. In arrangements of this type, the movements of the ram piston have been hitherto restricted by means of electric valves controlled by microcontacts, or by proximity detectors.

SUMMARY OF THE INVENTION

According to the invention, there is provided a device for controlling the expansion of a grinder of a grinding head, the expansion of which grinder is obtained by means of a cone rigid in translation with an expansion rod, said device comprising a fluid-operated ram of differential action type, said ram having a piston connected to the expansion rod, and means for slaving the piston in position, said means comprising a fluid valve and means for driving the valve, said drive means comprising a program-controlled stepping motor.

BRIEF DESCRIPTION OF THE DRAWING

An embodiment of the invention will now be described, by way of example only, with reference to the accompanying diagrammatic drawing, in which.

DESCRIPTION OF THE PREFERRED EMBODIMENT

Figure 1:
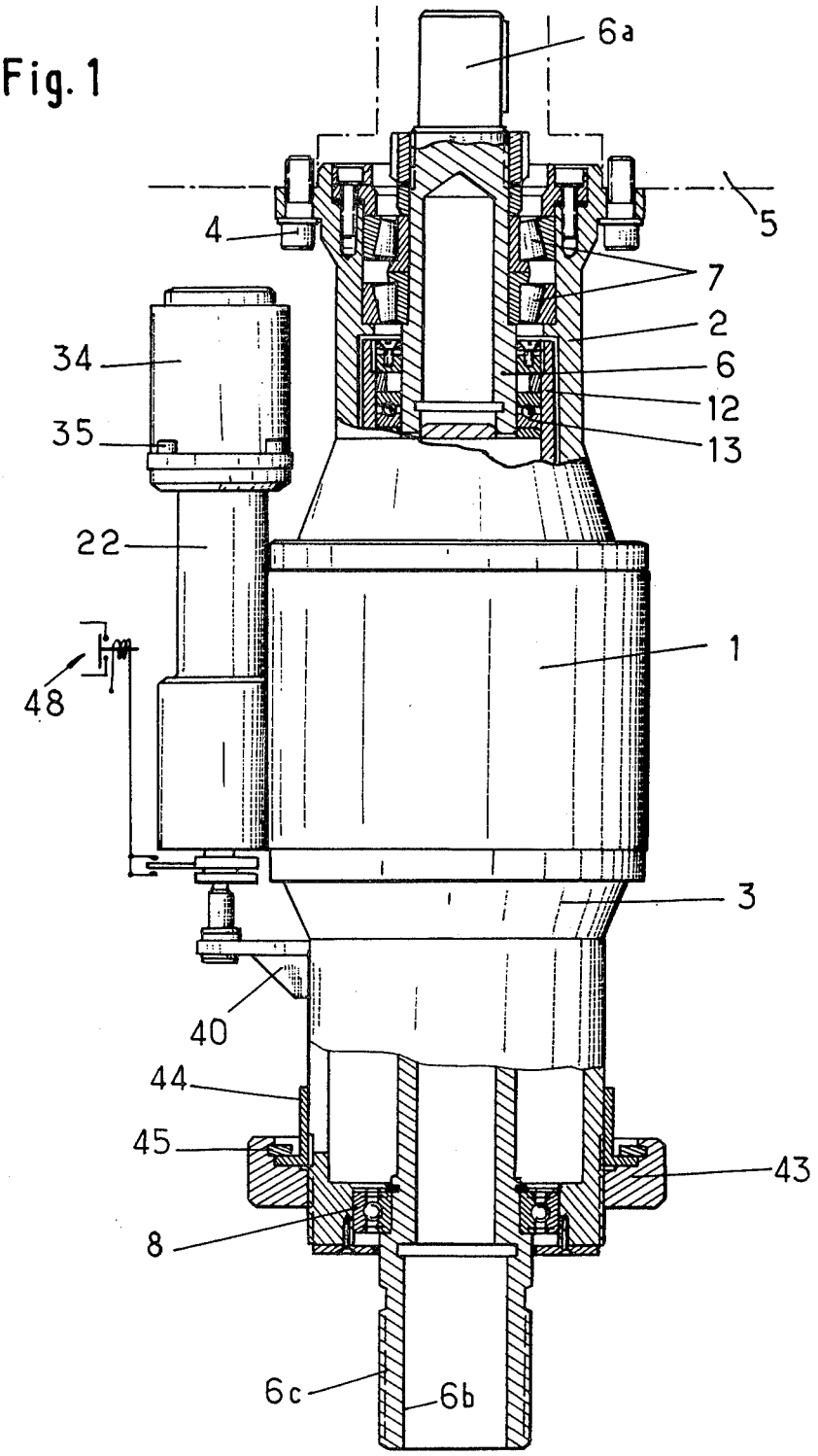
FIG. 1 is an elevation partially in cross-section of a grinding head fitted with a control device in accordance with the invention.
Figure 2:
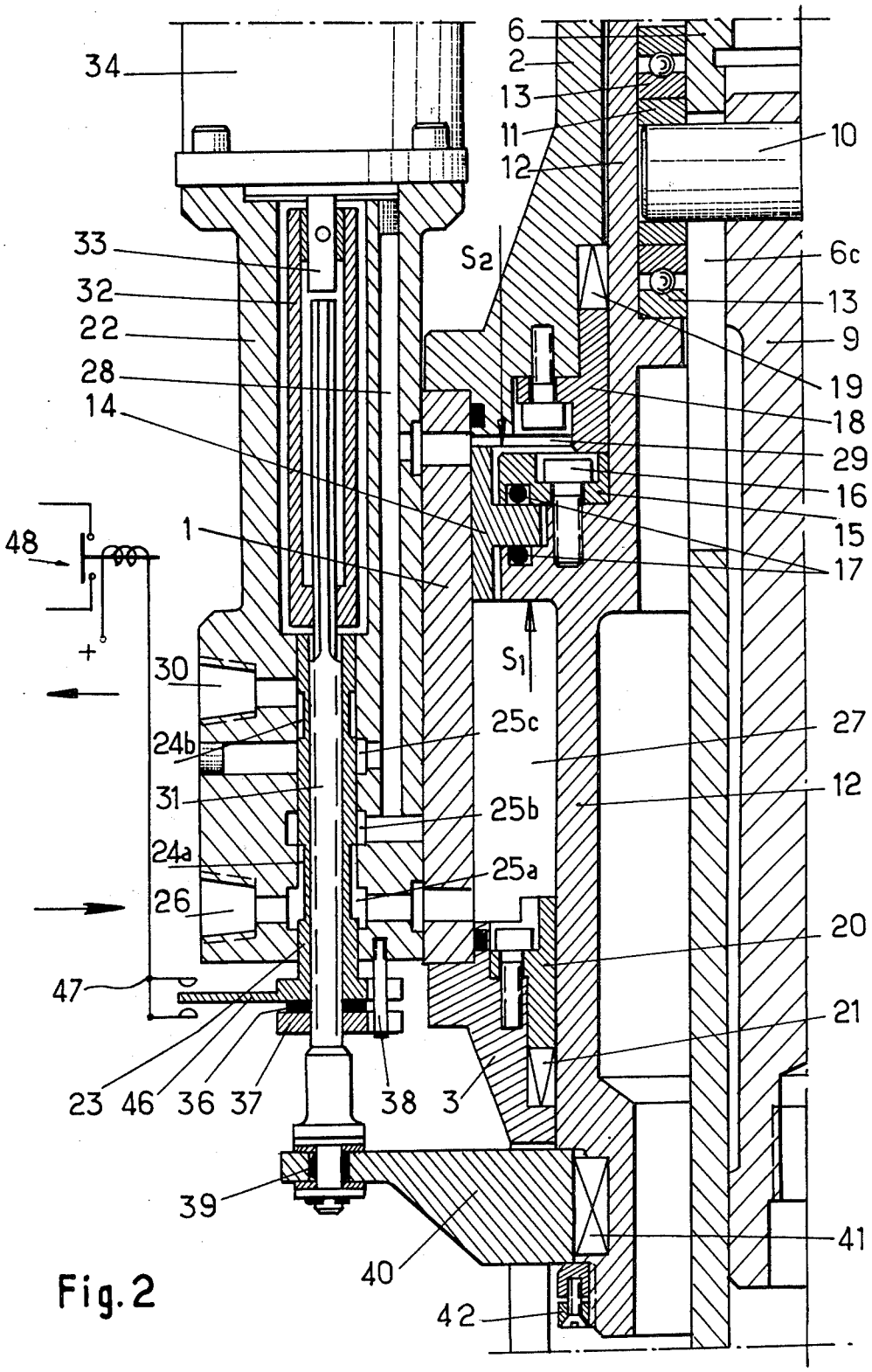
FIG. 2 is a section, to an enlarged scale, showing a hydraulic valve and ram of the control device.
Figure 3:
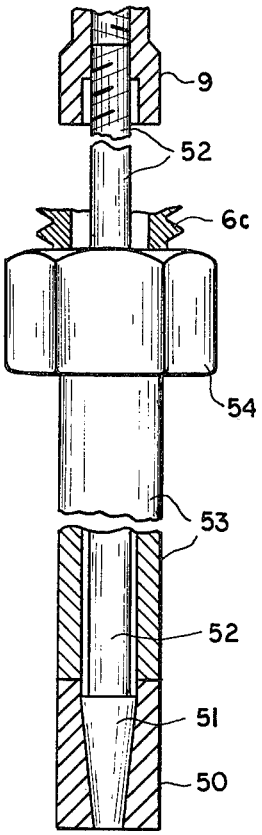
FIG. 3 diagrammatically shows the connection of the head to a grinder.

As shown in the drawings, the grinding head comprises a hydraulic ram formed by a cylinder 1 interposed between an upper body 2 and a lower body 3, these three elements being joined by means not represented on the drawing. The upper body 2 is fixed by means of screws 4 to a transversely movable member 5 of the grinding machine.

A driving pin 6 is rotatably mounted in the upper body 2 by means of roller bearings 7 and in the lower body 3 by a ball bearing 8. The pin comprises, at its top end, a cylindrical portion **6*a* provided with a key for connection with a corresponding female rotating part of the grinding machine. Its lower end has an internal cone 6*b* intended to receive a grinder holder 53 locked by a nut 54 screwed onto an external thread 6*c* of the pin 6**.

An expansion pin 9 is slidably mounted in the driving pin 6 and has, at its lower end, a tapped bore intended to receive the expansion rod 52 of the grinder 50. The pin 9 is rigid with a diametrical driving shaft 10 which passes through diametrically opposed longitudinal slots **6*c* in the pin 6. The ends of this shaft are fixed in rings 11 which are mounted in the piston 12 of the ram by means of ball thrust-bearings 13 coaxial with the pin. Axial movement of the piston 12 therefore effects axial movement of the expansion pin 9** and of the expansion rod which is connected with it.

A slide element 14 slidable within the cylinder 1 is fixed to the piston 12 by means of a plate 15 held by screws 16, with the interposition of sealing O-rings 17. This arrangement makes it possible to avoid the need for exact concentricity between the piston 12 and the bore of the cylinder 1, whereby the various parts do not have to be machined with the precision which would otherwise be required. The upper portion of the piston 12 in which the bearings 13 are mounted extends into the upper body 2 of the ram and is sealed relative to the cylinder 1 by a packing 19 confined by a guiding ring 18. The lower portion of the piston 12 passes through the lower body 3 of the ram and is sealed by a packing 21 confined by a guiding ring 20.

The piston 12, with its slide element 14, has a lower working surface $S_1$ and an upper working surface $S_2$ which is of greater area than the former, for example in a ratio of 2 to 1. For the piston to remain motionless, it is therefore necessary that the pressures applied on those surfaces should be in a ratio of 1 to 2.

On the cylinder 1 of the ram, a hydraulic slide valve body 22 is fixed. A valve slider or spool 23 is mounted in the body 22 for sliding movement in an axial direction. The valve spool 23 has two annular grooves **24*a* and 24*b* cooperating with annular grooves 25*a*, 25*b* and 25*c* in the valve body 22. The groove 25*a* establishes permanent communication between a fluid inlet port 26 and a chamber 27 delimited in the cylinder 1 by the working surface $S_1$. It can be placed in communication by means of the groove 24*a* with the groove 25*b*, which communicates through a duct 28 with a chamber 29 delimited in cylinder 1 by the working surface $S_2$. A fluid outlet port 30 may be placed in communication by means of groove 24*b* with the groove 25*c* which is itself in communication with the duct 28**.

The valve spool 23 has a threaded axial bore into which a screw 31 is engaged. The latter is slidably mounted in a rotary driving member 32 relative to which it cannot rotate and the internal cross-section of which is, for this purpose, for example polygonal or cruciform. The driving member 32 is connected to the output shaft 33 of a stepping motor 34 fixed on the valve body 22 by means of screws 35. The rotation of the shaft 33 thus effects rotation of screw 31 and, consequently, a longitudinal displacement of the valve spool 23.

To prevent any play between the thread of the screw 31 and the threaded bore of the valve spool 23, there is provided a ring 36 of elastomeric material which is interposed between the valve spool 23 and a play take-up nut 37 screwed on the screw 31. The valve spool 23 and this nut 37 are angularly fixed one relative to the other by a peg 38 which is rigid with the valve body 22 and is slidably mounted in a notch of the valve spool and in a notch of the nut.

The bottom portion of the screw 31 is fixed by means of a bearing and two needle thrust-bearings 39 to a bracket 40 which is mounted on the lower portion of the piston 12. This bracket is angularly fixed by a key 41 and is locked longitudinally by a nut 42. The screw 31 thus moves axially at the same time as piston 12.

A nut 43 is mounted on the bottom end of the lower body 3. An abutment 44 held by a resilient circlip 45 in the nut 43 limits the downward movement of the bracket 40.

Finally, the valve spool 23 is rigid with an abutment 46 arranged to control, in both directions of movement of the spool, a micro-contact 47 interposed on the circuit of a relay 48. This relay comprises a contact which is itself interposed on the supply circuit of the stepping motor 34 in such a way as to prevent starting of the motor, when it is excited, so as to limit the amplitude of movement of the spool 23.

The grinding head which has just been described operates as follows:

The piston 12 of the hydraulic ram 1 is motionless when the pressures exerted on its surface $S_1$ and $S_2$ create equal forces effective in opposite directions. This is achieved when the spool 23 of the hydraulic slide valve occupies the position represented in the drawing. In this position the smaller surface $S_1$ of the piston is subjected to the maximum pressure of the supply fluid while the surface $S_2$ of larger area is subjected to a lower pressure as a consequence of a restriction of the fluid flow between groove 24*a* and groove 25*b* and which causes a drop in pressure.

If the stepping motor 34 is then controlled to drive the screw 31 in a sense to displace the valve spool 23 upwards, the groove 24*a* is then located at least partially facing the groove 25*b* whereby the pressure of the supply fluid is exerted also on the surface $S_2$ of piston 12. As this surface $S_2$ has a greater area than that of surface $S_1$, the piston 12 moves downwards together with the expansion pin 9. The piston also moves the valve spool 23 downwards, by means of bracket 40 and screw 31; the movement stops when the spool 23 has resumed its equilibrium position.

In a practical example, the stepping motor 34 comprises 200 steps and the screw 31 is threaded to a pitch of 1 mm; one pitch thus corresponds to a movement of the valve spool 23 and therefore of the expansion pin 9, of five microns. In practice, the minimum number of steps required for the ram to react within an acceptable time was three, which corresponded to a fifteen micron movement of the pin; a smaller number of steps determined an insufficient opening movement of the valve spool, as a result of which piston 12 moved too slowly.

When the stepping motor 34 is driven in the opposite direction, the valve spool 23 moves downwards, so that the groove 24*b* brings the groove 25*c* into communication with the outlet port 30 whereby the chamber 29 delimited by the surface $S_2$ of the piston likewise communicates with the outlet port. The piston 12 thus moves upwards taking along on the one hand the expansion pin 9 and on the other hand the spool 23; the movement stops when the valve spool has resumed its equilibrium position.

It is thus seen that the movement of the expansion pin 9 is slaved to that of the motor 34, and that, according to the direction of rotation of the motor, there is obtained an expansion or contraction of the grinder. The frequency of the pulses applied to the motor 34 determines the speed of this expansion or contraction.

The control of the motor 34 is program controlled by a numerical control (N.C.) system. Should there be a breakdown of this control, the abutment 46 actuates the microcontact 47, which cuts off the supply to the motor 34.

The abutment 44, on meeting the bracket 40, limits the downward movement of piston 12, and thus the expansion of the grinder.

The numerical control of the motor 34 is dependent upon a "value reached" signal supplied by a self-gauging device of known type. From this signal it effects a slow contraction of the grinder, and then a fast contraction, and its fast expansion, the latter being followed by a slow operating expansion until the new desired value is reached.

The grinding head which has just been described constitutes a modular unit which can be used on all grinding machines. Its overall size is small and it is accurate, reliable and powerful.

What is claimed is:

1. A device for controlling the expansion of a grinder of a grinding head, the expansion of which grinder is obtained by means of a cone rigid in translation with an expansion rod, said device comprising a fluid-operated ram of differential action type, said ram having a piston connected to the expansion rod, and means for slaving the piston in position, said means comprising a fluid valve and means for driving the valve, said drive means comprising a program-controlled stepping motor, the valve being a slide valve comprising a valve slider and means defining a threaded bore in the slider, said drive means further comprising a control screw engaged in the threaded bore, and a sliding drive-transmitting member, said control screw being drivingly connected to the motor via the drive-transmitting member such that rotation of the motor effects an axial displacement of the valve slider, and a bracket rigid with the piston of the ram, and roller elements mounting said control screw in said bracket such that the control screw moves axially with the piston but is rotatable relative to the piston.

2. A device for controlling the expansion of a grinder of a grinding head, the expansion of which grinder is obtained by means of a cone rigid in translation with an expansion rod, said device comprising a fluid-operated ram of differential action type, said ram having a piston connected to the expansion rod, and means for slaving the piston in position, said means comprising a fluid valve and means for driving the valve, said drive means comprising a program-controlled stepping motor, the valve being a slide valve comprising a valve slider and means defining a threaded bore in the slider, said drive means further comprising a control screw engaged in the threaded bore, and a sliding drive-transmitting member, said control screw being drivingly connected to the motor via the drive-transmitting member such that rotation of the motor effects an axial displacement of the valve slider, and means for taking up play between the control screw and the valve slider, said play take-up means comprising a ring of elastomeric material and an adjustment nut on the control screw, said ring being disposed between the valve slider and the adjustment nut.

3. A device according to claim 2, wherein said valve further comprises a valve casing in which the valve slider is movable, said slider includes means defining a recess, and said nut includes means defining a recess, said device further comprising peg means rigid with the valve casing and slidably mounted in the recess of the slider and the recess of the nut so as to fix the slider and the nut against rotation.

4. A device according to claim 1, further comprising means for limiting the stroke of the piston of the ram, said stroke-limiting means comprising an abutment and nut means screwed onto the ram for adjusting said abutment, said abutment being engageable with the bracket mounting the control screw of the valve slider.

5. A device for controlling the expansion of a grinder of a grinding head, the expansion of which grinder is obtained by means of a cone rigid in translation with an expansion rod, said device comprising a fluid-operated ram of differential action type, said ram having a piston connected to the expansion rod, and means for slaving the piston in position, said means comprising a fluid valve and means for driving the valve, said drive means comprising a program-controlled stepping motor, said valve being a slide valve comprising a valve slider including an abutment, said drive means comprising a control circuit for the motor, said circuit including relay means for controlling the supply of current to the motor, and contact means for controlling operation of the relay means, said contact means being in the path of movement of the abutment such that the motor is stopped when the stroke of the slider has reached a predetermined value.

* * * * *